US007938272B2

(12) United States Patent
Antila et al.

(10) Patent No.: US 7,938,272 B2
(45) Date of Patent: May 10, 2011

(54) METHOD FOR CONTROLLING A SCREENING MACHINE AND A SCREENING MACHINE

(75) Inventors: Kari Antila, Tampere (FI); Hannu Heman, Tampere (FI); Mika Peltonen, Tampere (FI)

(73) Assignee: Metso Minerals Inc., Helsinki (FI)

( * ) Notice: Subject to any disclaimer, the term of this patent is extended or adjusted under 35 U.S.C. 154(b) by 607 days.

(21) Appl. No.: 10/522,177

(22) PCT Filed: Jul. 31, 2003

(86) PCT No.: PCT/FI03/00586

§ 371 (c)(1),
(2), (4) Date: Feb. 22, 2005

(87) PCT Pub. No.: WO2004/011159

PCT Pub. Date: Feb. 5, 2004

(65) Prior Publication Data

US 2006/0054539 A1 Mar. 16, 2006

(30) Foreign Application Priority Data

Jul. 31, 2002 (FI) ..... 20021428

(51) Int. Cl.
*B07B 13/16* (2006.01)

(52) U.S. Cl. ..... 209/247; 209/243

(58) Field of Classification Search ..... 209/242–246, 209/247, 922

See application file for complete search history.

(56) References Cited

U.S. PATENT DOCUMENTS

| | | | | | |
|---|---|---|---|---|---|
| 1,413,935 | A | * | 4/1922 | Ramsey et al. | 209/1 |
| 4,627,576 | A | * | 12/1986 | Hahn et al. | 241/24.1 |
| 4,665,772 | A | * | 5/1987 | Greene | 74/335 |
| 4,809,791 | A | * | 3/1989 | Hayatdavoudi | 175/40 |
| 5,038,911 | A | * | 8/1991 | Doane et al. | 198/357 |
| 5,236,093 | A | * | 8/1993 | Marrs | 209/552 |
| 5,248,042 | A | * | 9/1993 | Kuhmonen | 209/234 |
| 5,292,006 | A | * | 3/1994 | Girts, Jr. | 209/242 |
| 5,345,390 | A | * | 9/1994 | Greenip et al. | 700/175 |
| 5,503,712 | A | * | 4/1996 | Brown | 162/55 |
| 6,259,222 | B1 | * | 7/2001 | Kira | 318/571 |
| 6,343,234 | B1 | * | 1/2002 | Thomas | 700/28 |

FOREIGN PATENT DOCUMENTS

| | | |
|---|---|---|
| CN | 1292308 | 4/2001 |
| EP | 0 598 293 A1 | 5/1994 |
| JP | A-60-227872 | 11/1985 |
| JP | U-62-144584 | 9/1987 |
| JP | A-04-300681 | 10/1992 |
| JP | A-07-289936 | 11/1995 |

* cited by examiner

*Primary Examiner* — Joseph C Rodriguez
(74) *Attorney, Agent, or Firm* — Oliff & Berridge, PLC

(57) ABSTRACT

A screening machine including at least one screen surface, feeding means that feed material to be screened towards the screen surface and onto the screen surface where the material is separated into a first fraction remaining on the screen surface and into a second fraction passed through the screen surface while the material is moving along the screen surface. In a method for controlling the screening machine, the amount of material on the screen surface is determined by automatic measurement, and the speed of the feeding means is controlled on the basis of the measurement by automatic control.

14 Claims, 7 Drawing Sheets

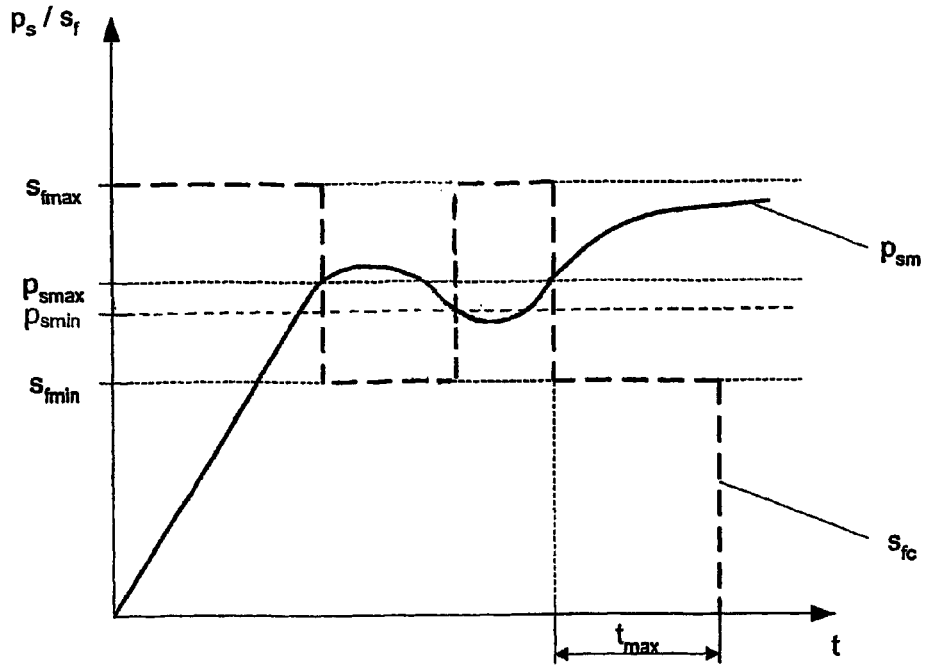

t = time $p_s$ = pressure of the screen drive system $s_f$ = speed of the feeding equipment $p_{sm}$ = pressure of the screen drive system as measured (imaginary)

$p_{smax}$ = maximum pressure of the screen drive system as set by the control system $p_{smin}$ = minimum pressure of the screen drive system as set by the control system $s_{fc}$ = speed of the feeding equipment as set by the control system to react to $p_{sm}$ $s_{fmin}$ = minimum speed of the feeding equipment as set by the control system $s_{fmax}$ = maximum speed of the feeding equipment as set by the control system $t_{max}$ = maximum duration of $p_{smax}$ overrun as set by the control system

*Fig. 4a*

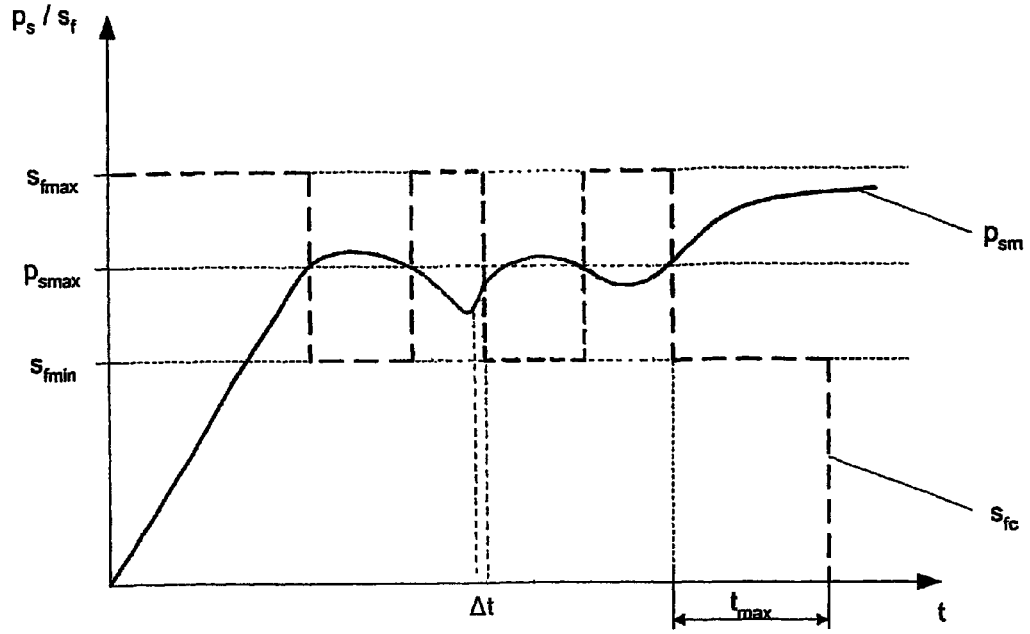

t = time $p_s$ = pressure of the screen drive system $s_f$ = speed of the feeding equipment $p_{sm}$ = pressure of the screen drive system as measured (imaginary)

$p_{smax}$ = maximum pressure of the screen drive system as set by the control system $(\Delta p_{sm}/\Delta t)_{max}$ = maximum speed of change of the pressure as set by the control system $s_{fc}$ = speed of the feeding equipment as set by the control system to react to $p_{sm}$ $s_{fmin}$ = minimum speed of the feeding equipment as set by the control system $s_{fmax}$ = maximum speed of the feeding equipment as set by the control system $t_{max}$ = maximum duration of $p_{smax}$ overrun as set by the control system

*Fig. 4b*

METHOD FOR CONTROLLING A SCREENING MACHINE AND A SCREENING MACHINE

BACKGROUND OF THE INVENTION

The invention relates to screening devices, more precisely to equipment used for feeding screening devices, as well as to a control system of the same.

It has been known heretofore to separate fractions of different sizes from a material by screening. For this purpose, a number of different kinds of screens have been developed, and vibrating screens and trommel screens can be mentioned as examples. To facilitate the feeding of the screen and the discharge of the screened material, the screens are seldom equipped with a power transmission of their own and with a control system of their own so that the screen, the power transmission and the control alone would constitute the screening machine, but typically various feeding equipment and discharging equipment are connected to the screening machine. Such devices can be for example vibrating feeders, conveyors, pendulum feeders, etc.

In practice, the screening machines are often composed at least of power transmission, control, a screen, a feeding conveyor and a discharge conveyor. Such a simple device is capable of performing a simple screening process, starting from the feeding of the material to the screen and ending in the discharge of the screened material fractions from the screen.

Typical feed materials include various earth materials, such as gravel, quarried rock, top soil (humus) and peat, as well as various products, by-products and wastes of industrial processes.

It is also known to equip the screening machine of the above kind with various auxiliary devices that further facilitate the screening. One such a device is a shredder that comminutes the pieces In the feed material that may obstruct the holes in the mesh if they reach the screen in full size. Such pieces may include, for example, root-lumps, sticks, branches or timber The screening machine often comprises two different discharge conveyors, wherein the accept and reject of the screen can be discharged far away from each other without their mixing with each other after the screening. If the screen is equipped with several screen decks, the screen is usually equipped with an even larger number of conveyors in such a manner that the reject of the topmost screen deck and the accept of each screen deck in the screen can be transferred away from the screening machine. Preferably the discharge conveyors are long, thus allowing the stacks of products to be conveyed as far away from the screening machine as possible. At the same time their discharge ends can be placed on a high level, wherein product heaps of large volume are attained.

Furthermore, it is known to equip the screening machine with wheels or tracks to facilitate its moving.

The power transmissions of screening machines are typically based on electric power transmission or hydraulic power transmission. The power source is typically a diesel engine, a separate electric generator or public electric power supply system.

In its simplest form the control of the screening machine is implemented in such a manner that the user starts and stops each processing unit of the screening machine separately by acting on the valves of a hydraulic circuit or the switches of an electric drive. As a rule, screening machines also contain one or more emergency stop devices typical for working machines.

More advanced devices utilize different microprocessor-based control systems wherein it is possible to facilitate the use of the machine. It is for example known to equip the screening machine with a PLC control (programmable logic controller), wherein the entire process of the screening machine can be started and stopped in accordance with programmed starting and stopping sequences with the push of one button.

It is also known to equip the processing units of the screening machine with different kinds of sensors to Indicate the status of operation of the machine to the user. For example by monitoring the operating speed of the screen itself or its input power, it is possible to determine whether the loading of the screen Is suitable in relation to its capacity.

Similarly, it is known to use sensor systems to indicate different faults in the machine to the user. By incorporating such condition monitoring sensors in the microprocessor-based control, it is possible to bring the screening machine to run down the screening process in a controlled manner in accordance with a programmed stopping sequence, for example in a situation where there is a risk of a damage, so that the machine is emptied of the material to be screened before it stops.

Other factors having effect on screening capacity include such as type of feed material, angle of the screen, area of the screen and the mesh type. These given, the main thing having effect on screening capacity is the feed capacity.

However, all known screening solutions share the same problem: it is difficult to optimize the feeding speed of the process. It demands a great deal of skill from the user of the machine to be able to adjust the feeding speed of the machine in case of varying feed material in such a manner that the maximum screening capacity could be obtained from the screening machine, and on the other hand in such a manner that the products produced by screening could be as clean as possible. Both of these objectives are significantly affected by the feeding capacity of the screen in such a manner that a feeding capacity that is normally too small produces a clean screening product of good quality, but a small production capacity. Too large a feeding capacity, in turn, normally results in a good production capacity, but at the cost of the purity of the screening.

The selection of the feeding capacity of the screening machine is a task of optimization in which the layer of feed material fed on the topmost deck of the screen must be sufficiently thick so that the screen would produce the maximum amount of screened end products. On the other hand, the user must be able to adjust the material on the screen into a sufficiently thin layer, so that the screen would not be overloaded and the purity of the screening would be maintained.

In this context the screening purity refers to that how well the different fractions are separated from each other. It is obvious for anyone skilled in the art that too thick a material layer on the topmost surface of the screen means that even some of the fractions smaller than the mesh size of the topmost screen deck travel over the entire mesh without ever passing through the mesh.

Thus, too thick a material layer also causes overloading of the screen. This causes reduction in the running speed of the screen, or in the case of certain types of vibrating screens, shortening of the vibrating movement and thus a reduction in the screening capacity. This may also cause various damages, for example damages in the power transmission means, bearings or drives, or even fatigue damages in the frame structures. Typical damages in the vibrating screen include for example damages in the springs or damages in the vibrator.

In practice, the overloading of the screen becomes evident in the hydraulic drive as an increase in the hydraulic pressure and in the electric drive as an increase in the current used by the drive motor. Irrespective of the driving method, overloading manifests itself in the worst case as a decrease in the running speed of the screen.

SUMMARY OF THE INVENTION

To solve the problems of the known method, the invention is mainly characterized by determining the amount of material on the screen surface by automatic measurement; and controlling the amount on the screen surface by adjusting the conveying speed of the conveyor on the basis of the measurement by automatic control in such a manner that the conveying speed, which is above zero, is changed to a different conveying speed, which is above zero, in specific ways using upper and lower preset values for the measurement value of a variable dependent on the amount of the material on the screen surface and a preset value for a speed of change of the measurement value of the variable dependent on the amount of material on the screen surface.

The screening machine according to the invention is characterized by a sensor arranged to measure a variable dependent on the amount of material on the screen surface;

a controller to which said sensor is connected through a data transmission line to receive a measurement value related to said variable from the sensor;

and an actuator operatively connected to the conveyor and arranged to change the conveying speed of the conveyor, wherein said controller is connected to said actuator through a data transmission line and arranged to give a control command to said actuator in response to the measurement value received from the sensor to change the conveying speed of the conveyor, which is above zero, to a different conveying speed, which is above zero, in specific ways using the above-mentioned preset values.

It is an advantage of the invention that the screening machine is capable of automatically adjusting the feeding of the material to be screened to the screen in such a manner that the screening process produces a maximum result without damages to the screening machine itself or without impairing the purity of the screening. The invention is based on the determination of the amount of material on the screen, which can be performed indirectly by measuring automatically a suitable variable. The fact that a vibrating screen needs input power to function can be utilized.

BRIEF DESCRIPTION OF THE DRAWINGS

The invention will now be described in more detail by means of preferred embodiments with reference to the appended drawings, in which FIGS. 4*a* and 4*b* show the behaviour of two variables to be monitored as a function of time when one of them is monitored and the other one is controlled by means of the control method of the invention

DETAILED DESCRIPTION OF THE INVENTION

Figure 1:
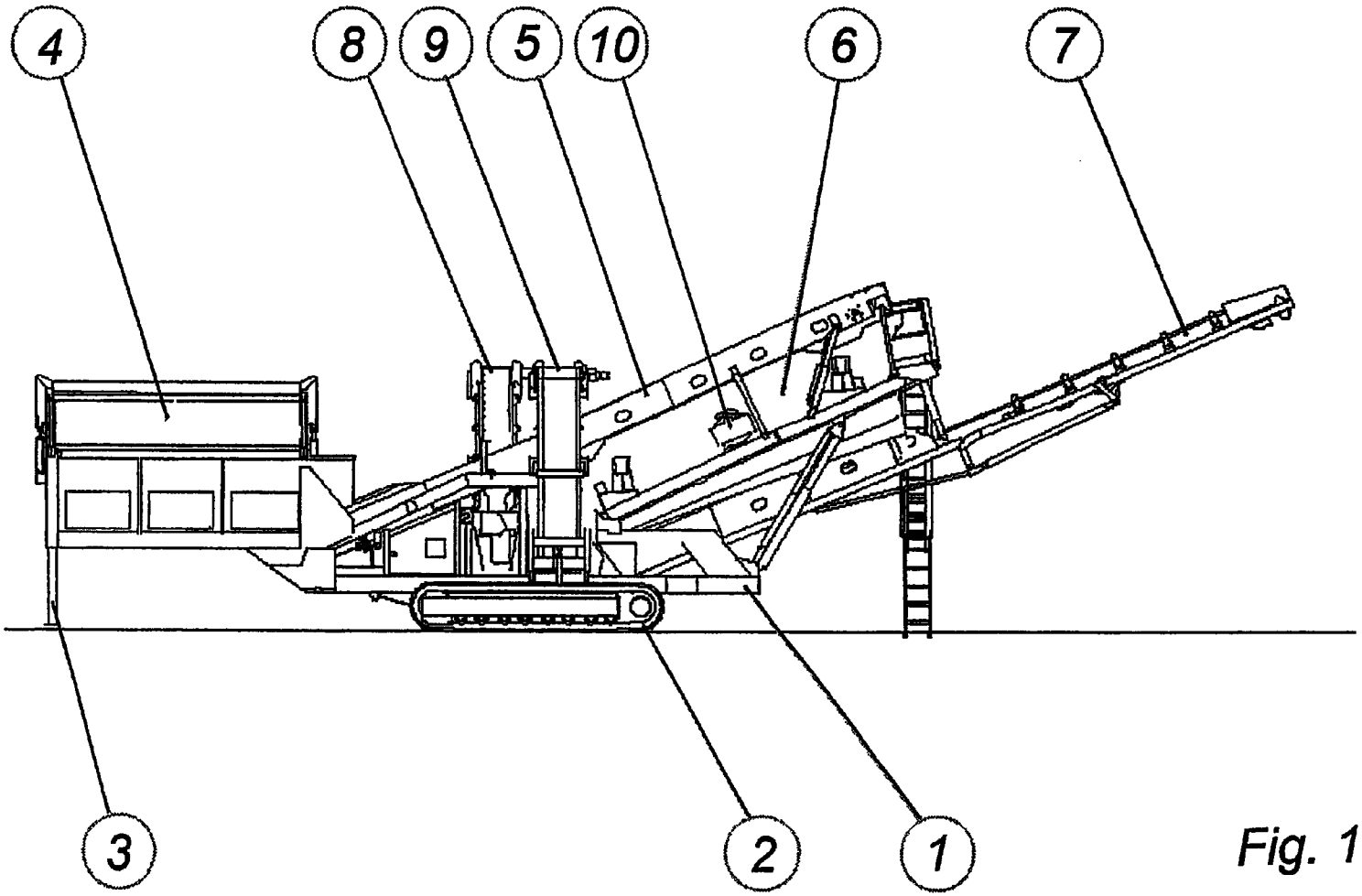
FIG. 1 shows a self-propelled, track-mounted screening machine where the invention can be applied.

The parts of the embodiment of the invention shown in FIG. 1 are frame 1, tracks 2, support legs 3, feed hopper 4, lifting conveyor 5, screen 6, main discharge conveyor 7, wing discharge conveyors 8,9, and vibrator 10.

FIG. 1 shows a self-propelled, track-mounted screening machine having functional elements well-known in prior art in its operating position. The main parts of the machine include a frame 1 that connects the processing units of the screening process to each other. The screening machine can be moved on the support of tracks 2 connected to the lower part of the frame for example by means of hydraulic pressure produced by a hydraulic pump (not shown) driven by means of a diesel engine (not shown). Typically the screening machine contains one common hydraulic system that drives all the processing units of the machine, but separate hydraulic systems are also used. Completely electric power transmissions are also known.

In the operating position the screening machine rests on the ground, not only on the support of the tracks, but also on the support of support legs 3.

The processing units participating in the actual screening process are a feed hopper 4, a grizzly module (not shown), a feed hopper conveyor (not shown), a lifting conveyor 5, a screen 6, a main discharge conveyor 7 and wing discharge conveyors 8,9. In this case the screen is a two-deck vibrating screen, the vibrating movement of which is produced by a vibrator 10.

The feeding of the screening machine takes place for example by using a shovel loader, by means of which the feed material is transported to the feed hopper. In the upper part of the feed hopper there is typically a grizzly module (not shown), the purpose of which is to remove oversized particles from the feed material. The feed material that passes through the grizzly module enters the feed hopper 4 that guides the feed material to the feed hopper conveyor (not shown) that is located on the bottom of the feed hopper. The feed hopper conveyor moves the feed material further to the lifting conveyor 5, which lifts the feed material further on top of the upper screen deck of the screen. Thus, the feeding equipment of the screening machine according to FIG. 1 is composed of a combination of the feed hopper conveyor and the lifting conveyor. These two conveyors can be driven with the same hydraulic drive circuit, wherein the speeds of the same are synchronized.

In this case the screen 6 is tilted in such a manner that the lifting conveyor 5 brings the material to the upper end of the screen 6, from which gravity and the vibrating movement of the screen convey the feed material towards the lower end of the screen. In an optimal situation, the speed of the lifting conveyor is such that in the upper end of the screen the feed material is first spread on the surface of the topmost screen deck, thus forming an even layer that becomes thinner towards the lower end of the screen in such a manner that only particles larger than the holes on the screen deck are left of the feed material on the top deck at this end of the screen.

The part of the feed material layer that does not pass the upper screen deck ends up on a first wing discharge conveyor 8. The part of the feed material layer that passes through the upper screen deck, but not the lower screen deck ends up on a second wing discharge conveyor 9. The part of the feed material that passes through the lower screen deck as well ends up on the main discharge conveyor 7.

The screen decks can be changed to screen decks of different types according to the requirements set by the feed material and the products and it is possible to use screen holes of different sizes and shapes therein. As an example it is possible to mention rubber mesh and woven steel wire decks with circular, elongated or rectangular holes.

In some applications, a shredder (not shown) is placed between the feed hopper conveyor (not shown) and the lifting conveyor 5, the purpose of which is to shred large root lumps or other corresponding particles that are easily tangled in the screen decks, thus obstructing the holes therein. The shredding may be based for example on the movement of rotating blades.

Figure 2:
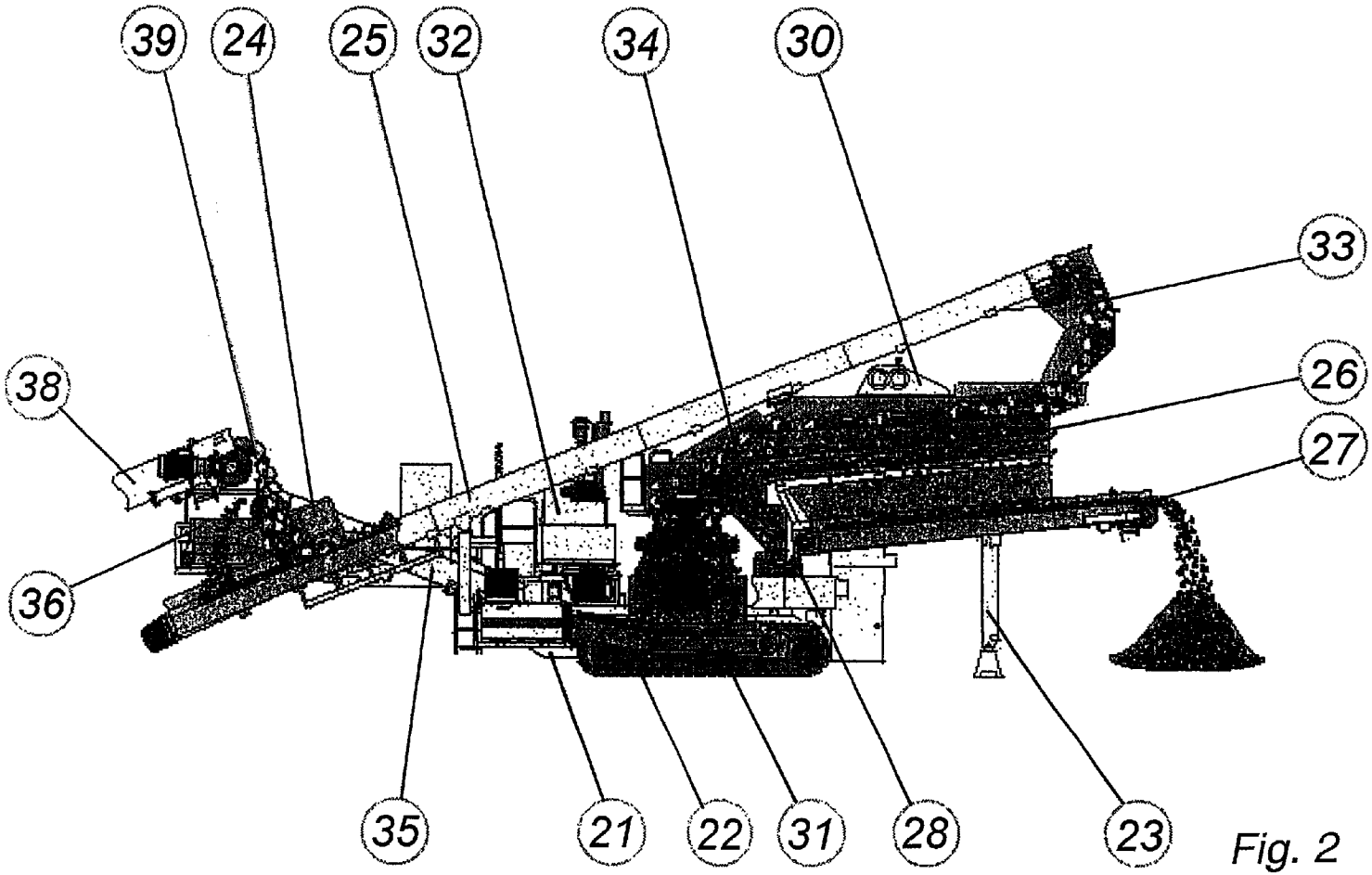
FIG. 2 shows another self-propelled, track-mounted screening machine where the invention can be applied.

The parts of the embodiment of the invention shown in FIG. 2 are: frame 21, tracks 22, support legs 23, feed hopper 24, lifting conveyor 25, screen 26, main discharge conveyor 27, wing discharge conveyor 28, vibrator 30, crusher 31, diesel engine 32, lifting conveyor chute 33, distribution chute 34, return conveyor 35, return conveyor chute 36, feeding machine conveyor 38, and feed material 39.

FIG. 2 shows a self-propelled, track-mounted screening machine in its operating position. The main parts of the same include a frame 21 that connects the processing units of the screening process to each other. The screening machine can be moved on the support of tracks 22 connected to the lower part of the frame for example by means of hydraulic pressure produced by a hydraulic pump (not shown) driven by means of a diesel engine 32.

In the operating position the screening machine rests on the ground, not only on the support of the tracks, but also on the support of the support legs 23.

The processing units participating in the actual screening process are a feed hopper 24, a lifting conveyor 25, a lifting conveyor chute 33, a screen 26, a distribution chute 34, a return conveyor 35, a return conveyor chute 36, a main discharge conveyor 27 and a wing discharge conveyor 28. In this case the screen is a three-deck vibrating screen, the vibrating movement of which is produced by a vibrator 30.

The feeding of the screening machine takes place for example by means of a crushing machine on whose discharge conveyor 38 the feed material 39 is brought to the feed hopper 24 that guides the feed material to the lifting conveyor 25, which, in turn, lifts the feed material under the guidance of the lifting conveyor chute 33 further on the topmost screen deck of the screen 26. Thus, the feeding equipment of the screening machine according to FIG. 2 is primarily composed of a lifting conveyor, but it is also possible to consider as feeding equipment all the devices that are coupled to the same control with the screening machine and that precede the screening machine in the process, for example said crushing machine and the devices feeding the crushing machine.

In this case the screen 26 is directionally vibrating, so to say, which allows it to be placed in an approximately horizontal position in the screening machine. The directional vibrating movement conveys the material layers formed by the feed material 39 on the surface of the screen decks towards the distribution chute 34. In an optimal situation, the conveying speed of the lifting conveyor is such that the feed material is first spread on the surface of the topmost screen level at the screen end next to the lifting conveyor chute 33, thus forming an even layer that becomes thinner towards the screen end next to the distribution chute 34 in such a manner that only particles larger than the holes on the screen deck are left of the feed material on the top deck at this end of the screen.

The part of the feed material that does not pass through the topmost screen deck ends up to the crusher 31 under the guidance of, the distribution chute 34. The crusher reduces the particle size of the reject of the screen. Gravity moves the material crushed by the crusher to the return conveyor 35 that returns it back to the lifting conveyor 25 via the return conveyor chute 36. Thus, a so-called closed circulation is formed in which the particles of feed material circulate until their grain size is sufficiently small to pass through the topmost screen deck of the screen 26.

The part of the feed material layer that passes the topmost screen level but not the screen deck in the middle ends up on a first wing discharge conveyor 28 under the guidance of the distribution chute 34. The part of the feed material layer that passes through the screen deck in the middle as well, but not the lowermost screen deck ends up on a second wing discharge conveyor (not shown) under the guidance of the distribution chute 34. The part of the feed material layer that also passes through the lowermost screen deck ends up on the main discharge conveyor 27.

Similarly to the screening machine in FIG. 1, the screening machine of FIG. 2 can, of course, also be equipped in different ways.

Typically the screening machines shown in FIGS. 1 and 2 are equipped with different kinds of sensors that are connected either to the alarm or control system of the machine, said sensors monitoring the state of the machine. It is possible to monitor for example:

- the running speed of the screen
- the pressure of the hydraulic drive of the screen or the current used by the electric drive of the screen
- the temperature of the hydraulic fluid
- the temperature and oil pressure of the diesel engine
- the engine load.
- the running speed of the shredder
- the pressure of the hydraulic drive of the shredder or the current used by the electric drive of the shredder
- the running speed of the crusher
- the pressure of the hydraulic drive of the crusher or the current used by the electric drive of the crusher
- the running speed of the discharge conveyor/conveyors
- the pressure of the hydraulic drive of the discharge conveyor/conveyors or the current used by the electric drive of the discharge conveyor/conveyors It is also known to connect the sensors monitoring the above-mentioned variables, or other variables to be monitored, to the control of the machine In such a manner that in the case of an alarm the machine stops or runs itself down in a controlled manner. Such an alarm may be caused for example by overheating of the motor or a sudden failure-based halt of a processing unit.

The control system of a screening machine of prior art may also be connected to a machine preceding or following the same in the process. Such a machine can be for example a crusher, the function of which is to comminute the reject of the screen obtained from the wing discharge conveyor 8 of the embodiment of FIG. 1 to a reduced size. As another example it is possible to mention the crushing machine of the embodiment of FIG. 2 that feeds the screening machine. The advantage attained by connecting the control systems of machines in this way is that it is possible to connect the machines to a common emergency stop circuit, wherein when the emergency stop switch of any of the machines is activated by the user, all the machines connected together are stopped. It is also possible to connect the microprocessor-controlled machines to a common start and stop sequence, wherein it is possible to ensure that the machines that are connected together are emptied of the material when stopped, and on the other hand, none of the parts of the process will overflow in connection with the startup.

The sensors and circuits above are known from the prior art. However, the Importance of monitoring the amount of material on the screen has not been recognized before.

In the following, the control principle of the present invention and its variations are described in more detail. Existing sensors can be utilized in a new way, or the machine and any machines connected to the same process can be equipped with sensors for the purpose of the control method.

Figure 3:
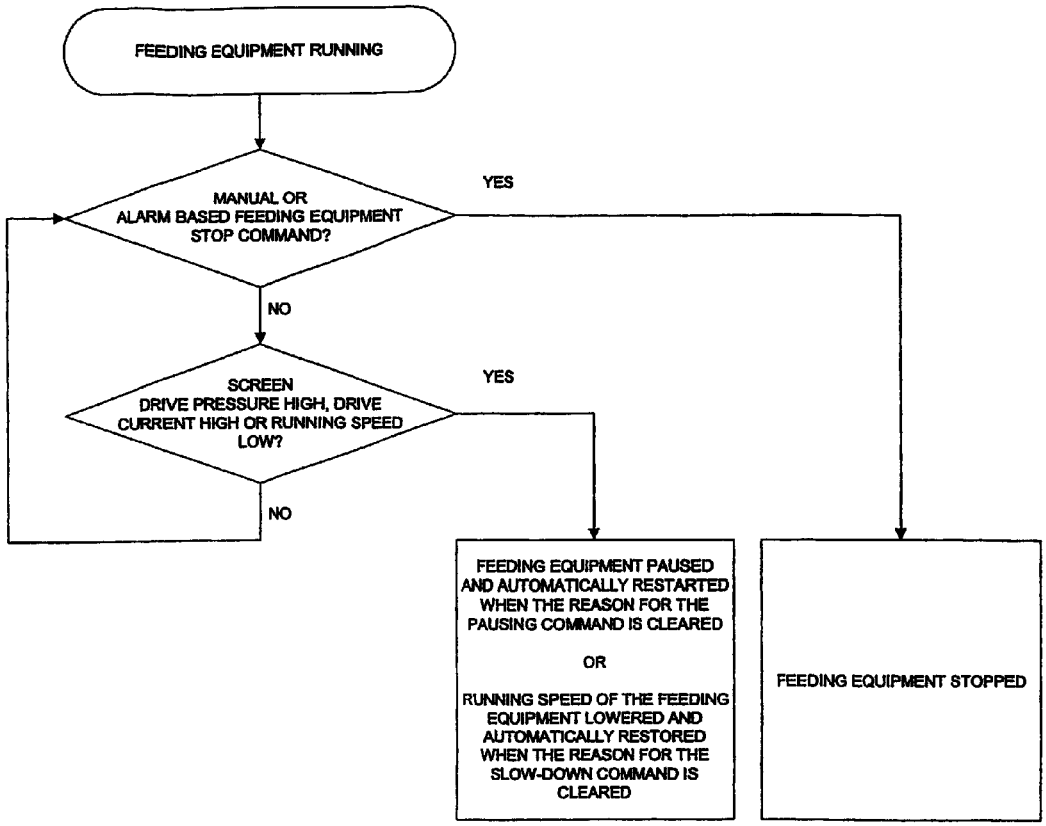
FIG. 3 shows the control method of a screening machine according to the invention

FIG. 3 shows a control method of a screening machine according to the invention. Initially, the feeding equipment operates normally. A microprocessor control checks at predetermined Intervals whether a manual or an alarm-based stop command has been given to the machine. If such a command has been given, the microprocessor control stops the feeding equipment immediately.

If the aforementioned condition is not fulfilled, the microprocessor control checks at predetermined intervals whether the screen is overloaded. This Is determined on the basis of Information transmitted to the microprocessor control by the sensor system of the screen. The microprocessor control understands that the screen is overloaded if the running speed of the screen has been reduced under a predetermined limit, if the pressure of the hydraulic oil in the drive circuit of the hydraulically operated screen has increased over a predetermined limit, or if the current used by the motor of the electrically driven screen has increased over a predetermined limit. All these variables are related to the movement of the screen or to the operation of the drive means (vibrator) causing the movement of the screen. One sensor specifically designed to get information about the state of the screen could be an optical sensor that monitors the movement of the screen, that is, the speed of movement. Other sensors capable of directly obtaining data about the movement of the screen can also be used. They can be for example connected mechanically to the screen.

If the microprocessor control detects that the loading of the screen is normal, the microprocessor control continues the above-mentioned checkings at predetermined intervals.

If the microprocessor control detects that the screen is overloaded the microprocessor control upon selection either stops the feeding equipment or decelerates its running speed to reduce the loading exerted on the screen until the overloading state is over. In an optimal situation the microprocessor only decelerates the feeding, but a maximum time for the allowable duration of the overloading state is also set therein. When this maximum time is exceeded, the microprocessor control stops the feeding entirely.

It is clear that the system as shown in FIG. 3 can include the functions permitting it to operate on the principles to be described below with reference to FIGS. 4*a* and 4*b*.

FIG. 4*a* shows in detail the behaviour of the control in a situation In which the measured pressure $p_{sm}$ (the drawing shows the imaginary behaviour of the pressure) of the hydraulic drive circuit of a hydraulically operated screen develops according to a predetermined curve. Two limit values, an upper value $p_{smax}$ and a lower value $p_{smin}$ is used for the pressure of the hydraulic drive circuit of the screen. When the pressure $p_{sm}$ exceeds the maximum value $p_{smax}$ preset in the control, the control decelerates the running speed $s_{fc}$ of the feeding equipment from the preset maximum value $s_{fmax}$ to the preset minimum value $s_{fmin}$. When this action of reducing the speed has reduced the loading of the screen, the measured pressure $p_{sm}$ of the hydraulic drive circuit of the screen is normally reduced below the preset maximum value $p_{smax}$ of pressure.

When the measured pressure decreases below this maximum value $p_{smax}$, the control does not take any action for increasing the running speed $s_{fc}$ of the feeding equipment, but the running speed is changed (increased) only after the measured pressure has passed the lower value $p_{smin}$. When the measured pressure exceeds the lower value, the control does not take any action, and the speed is changed (lowered) only after the measured value has passed the upper value $p_{smax}$. It is thus possible to define an upper limit value and a lower limit value which can be entered in the control system by suitable data input means in numerical form and changed if necessary, for example when the raw material and/or screen is changed. The speed $s_{fc}$ can be kept constant, even if the measured values fluctuate, provided that they are between the upper value and the lower value.

However, in the example shown in FIG. 4*a*, the last pressure increase in the drive circuit of the screen is abnormal. Although the control system, after the measured value has exceeded the upper value $p_{smax}$, reduces the running speed $s_{fc}$ of the feeding equipment to the minimum value $s_{fmin}$ again, the pressure $p_{sm}$ of the drive circuit of the screen still remains above the maximum value $p_{smax}$ of pressure preset in the control. This may indicate for example a bearing failure or a complete blockage of the screen decks.

In this example, a maximum time $t_{max}$ that the control system tolerates a situation where the pressure $p_{sm}$ exceeds the $p_{smax}$ is also preset in the control. When this maximum time runs out, the control stops the feeding equipment entirely. Thus, the control system is capable of taking into account the seriousness of the disturbance situation as well.

It is obvious for anyone skilled in the art that a conventional area of hysteresis may be related to the above-mentioned threshold values.

Further, instead of changing the feeding speed when a preset limit value of the measured variable is reached, the automatic control can monitor the speed of change of the variable and take action when a preset value of speed of change is exceeded. In this case it is advantageous to have limit values of the variable as well. FIG. 4*b* shows a control principle where one single preset value $p_{smax}$ is used. When the pressure $p_{sm}$ exceeds the maximum value $p_{smax}$ preset in the control, the control decelerates the running speed $s_{fc}$ of the feeding equipment from the preset maximum value $s_{fmax}$ to the preset minimum value $s_{fmin}$. When the measured pressure $p_{sm}$ of the hydraulic drive circuit of the screen is reduced below the preset maximum value $p_{smax}$ of pressure, the control increases the running speed $s_{fc}$ of the feeding equipment from the preset minimum value $s_{fmin}$ back to the preset maximum value $s_{fmax}$. If the pressure $p_{sm}$ in the graph of FIG. 4*b* rises sharply so that the speed of change of the measured pressure exceeds a preset value, as occurs during a period $\Delta t$, this causes the decrease of the speed of the feeding equipment even before the preset maximum limit pressure $p_{smax}$ is reached. This type of predictive control is preferably used when the measured pressure is above a predetermined lower pressure. In this case also a minimum pressure according to FIG. 4*a* is used.

It is also possible to use this principle if the speed of change has an opposite sign, that is, it decreases below a preset negative value (exceeds the preset absolute value). Applied to FIG. 4*b* this means that if the measured pressure $p_{sm}$ falls rapidly, the feeding speed is increased already before the pressure has decreased below the preset maximum limit value $p_{smax}$.

The predictive control where the speed of change of the measured variable is used can be applied also to the procedure of FIG. 4*a*, where the speed of change, when the measured value of the variable is between the upper and lower preset values, causes the increase or decrease of the feeding speed already before the corresponding preset value is passed.

It is also obvious that the principle of FIG. 4*a* or FIG. 4*b* can be applied If another variable of the screen drive means than pressure, for example electric current, is measured. The same principle can be applied if the drive running speed is measured. In this case the running speed is inversely proportional to the load but the procedure is analogous to FIGS. 4*a* and 4*b*. If absolute numerical values are processed, this means that if the measured value exceeds the preset maximum value, the feeding speed is increased, and if the measured value decreases below the preset minimum value (which represents the overload situation), the feeding speed is decreased. Correspondingly, when applied to FIG. 4*b*, the speed of change that triggers the command to decrease the feeding speed is negative, and if the predictive control procedure of FIG. 4*b* is used for increase of the feeding speed, the speed of change that triggers the increase in feeding speed is positive.

Thus, common to all alternatives according to FIG. 4*a* is that if the measured value ($val_m$) passes beyond one of the preset limit values ($val_{max}$, $val_{min}$) from the area between these preset limit values, the feeding speed is increased, and if it passes the other preset limit value from this area, i.e. the the measured value moves in an opposite direction, the speed is decreased. The preset limit value for the speed of change according to FIG. 4*b* can, in turn, described with symbol $(\Delta val_m/\Delta t)_{max}$.

As mentioned above, the speed of the screen itself can be determined in a suitable manner from the movement of the screen. This variable can be used in the control according to the same principle as the drive running speed.

Figure 5:
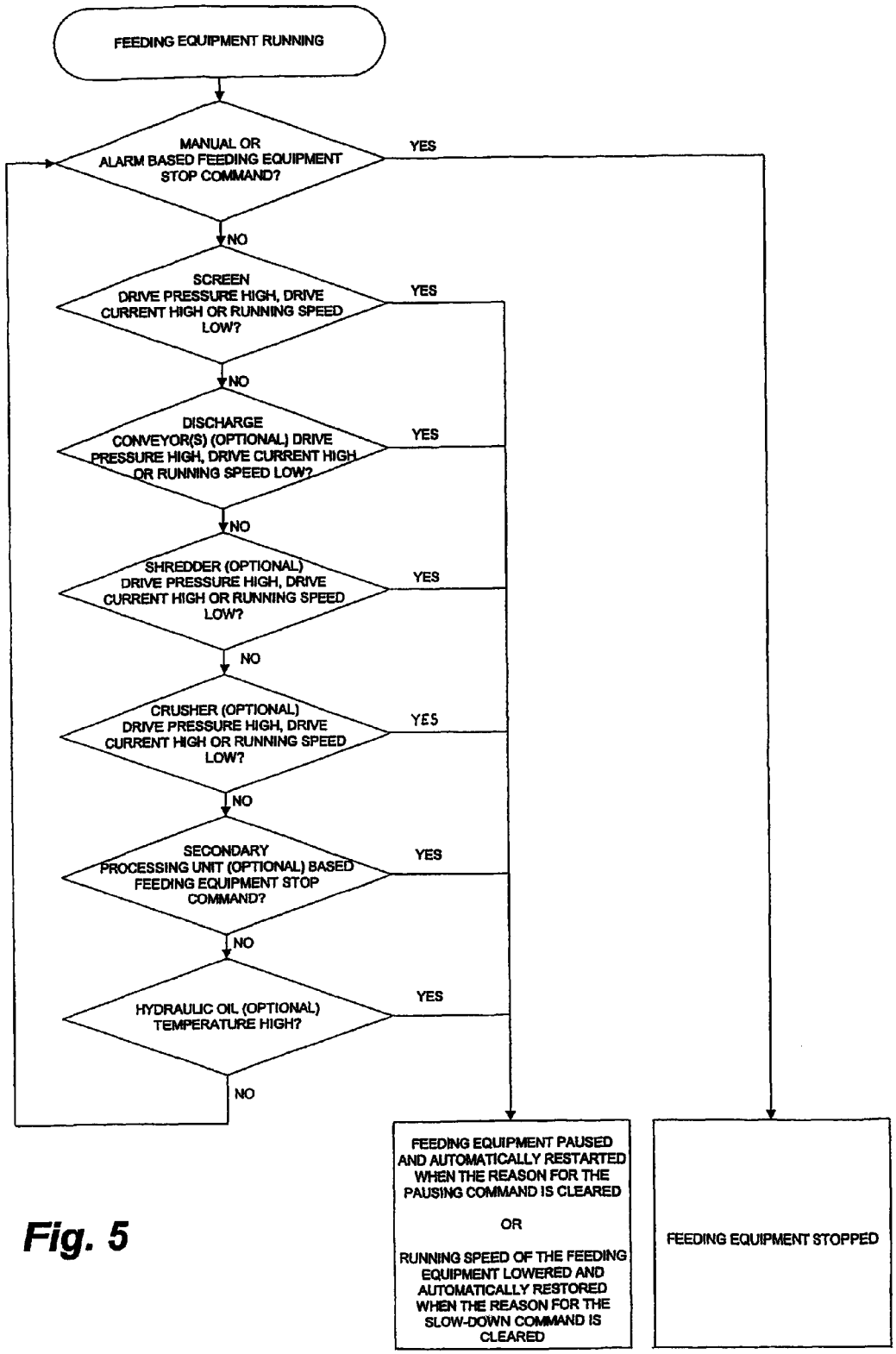
FIG. 5 shows another control method of a screening machine according to the invention.

FIG. 5 shows a control method of a screening machine according to the invention. When compared to the situation of FIG. 3, the screening machine now also contains one or several of the following optional equipment: a discharge conveyor or several of them, and/or a shredder and/or a crusher and/or another processing device, such as a crushing machine or another screening machine following the screening machine in the direction of the process. Furthermore, the screening machine controlled by the control according to FIG. 5 also comprises a hydraulic drive at least in one processing unit.

As can be seen in FIG. 5, the control system is also suitable for the control of a quite complex screening machine.

The feeding equipment whose feeding speed is adjusted automatically during the operation of the screening machine is located upstream of the screen. The measurement value for the control is preferably obtained from the operation of the screen, as described above. However, information about the state of the screen can be obtained also Indirectly from the status of other processing units of the screening machine or any machine following the screening machine in the direction of processed material flow, as described hereinabove. The processing units are preferably units downstream of the screen, such as the crusher 31 of FIG. 2 collecting the material from the topmost screen deck or some of the discharge conveyors conveying a fraction of the screened material. If a shredder is used upstream of the screen between the feed hopper conveyor and the lifting conveyor, its status can also be monitored. The machine following the screening machine can be a second screening machine, a crushing machine or a conveying machine, and they are connected to the control system of the screening machine.

The load caused by the material or any of the above-mentioned processing units or any of the above-mentioned machines following the screening machine can be determined. The load on these parts can be an indication of the amount of material on the screen itself. Drive pressure (if hydraulically operated), drive current (if electrically operated) or running speed can be the variables that are measured when the load caused by the material is determined. If there is a correlation between the load caused by the material and the load of the engine of the respective processing unit or any machine following the screening machine in the same process, the load of the engine can be determined. Similarly, if there is a correlation between the temperature of the hydraulic fluid of the hydraulic system of the respective processing unit or any machine following the screening machine in the same process, the temperature of the hydraulic fluid can be determined.

Figure 6:
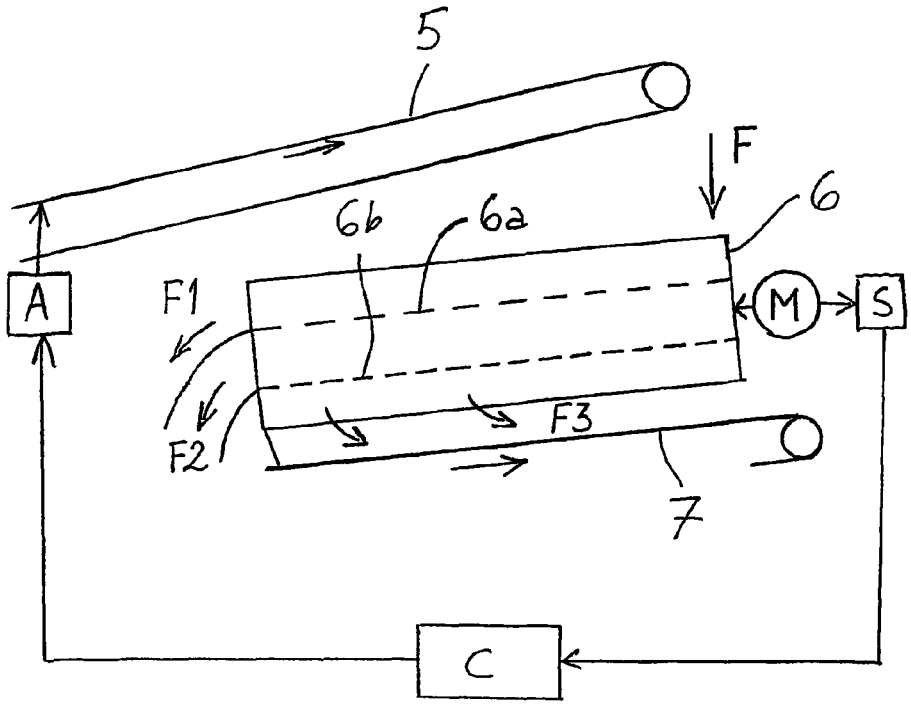
FIG. 6 shows a closed control loop according to the invention.

In FIG. 6, a closed control loop according to the invention is shown in simplified representation, where the functional parts of the screening machine, shown only schematically, are denoted with the same numerals as in FIG. 1. Drive means causing the movement of the screen 6 is denoted with letter M. A sensor S measures a variable of the drive means M. The sensor S transmits the measurement value through a data transmission line to a micro-processor-based controller C, which gives a control command through another data transmission line to an actuator A capable of affecing the feeding speed of a feeding means upstream of the screen 6. The controller C contains a comparator that compares the actual measurement result with the preset value. As can be seen in FIG. 6, the screen 6 has an upper deck 6*a* separating a first fraction F1 from the feed F, and a lower deck 6*b* dividing the fraction passed through the upper deck into a second fraction F2 and a third fraction F3. Of course, the invention is not limited to screening machines with a predetermined number of screen decks, but the number of decks can be larger or smaller than that presented in FIG. 6.

Data input means for entering the preset values in the controller C are denoted with letter I. They can be for example a keyboard.

It should be noted that the closed control loop of FIG. 6 can be applied in an analogous manner when the sensor S measures a variable dependent on the amount of the material on the screen elsewhere than in connection with the screen, such as by measurement of load on other processing units of the screening process.

The actuator A by means of which the speed of the feeding means can be changed can be any control device that can alter a variable that has effect on the feeding means, for example a variable of the drive system of the feeding means. If the feeding means has a hydraulic drive, the actuator can affect the pressure or the volume flow rate (pump output) of the hydraulic medium. If the drive is electric, the actuator can affect an electric variable of the electric motor.

There are many alternatives for the actuator in the practice. If it is a hydraulic valve of the hydraulically operated feeding device, it is preferably analogically controllable, for example equipped with a pulse width modulation type control. Correspondingly, the electrically operated feeding equipment can be controlled for example with a frequency converter.

The invention is not restricted solely to the screening machine equipped with a vibrating screen that is presented in the example. The screen can also be a trommel screen. Both screens require a movement of some kind to operate, and the amount of material on their screen surfaces can be determined by measuring a variable related to their movement or to the operation of their drive means.

The invention is not restricted solely to a screening machine equipped with a feed hopper conveyor+lifting conveyor feeding that is presented in the example. The feeding equipment can also be either of these alone. The feeding equipment can also consist of a vibrating feeder or a pendulum feed or any other processing unit located upstream the screen and limiting the feed capacity.

The invention is not restricted solely to the exemplary self-propelled screening machine equipped with a feeding arrangement of its own either. The screening machine can also be stationary, and the feeding equipment, as well as the other processing units of the screening process can stand on bases of their own.

The invention is not restricted to any specific number of hydraulic circuits either. All the processing units of the screening process may be coupled to a common hydraulic circuit, or they may all be independent.

The discharge conveyors may be coupled to a common power transmission in such a manner that in an overloading situation they are all decelerated simultaneously, and their pressure increases simultaneously, or separately so that they must each be monitored separately.

The feeding equipment whose speed is controlled on the basis of the amount of the material on the screen can be any feeding means located upstream of the screen and capable of affecting the accumulation of the material on the screen by its feeding speed. This feeding means can be a single conveyor or a combination of conveyors whose speeds are synchronized.

The means necessary for implementing the invention are known as such. The sensors that are used are conventional speed, pressure and temperature sensors. They are as a rule analog sensors. The speed sensors can also be digital pulse sensors.

Before processing the measurement data in the microprocessor, it may be necessary to use conventional processing methods of the measurement signal, such as amplification and A/D and D/A conversion. This also applies when the control commands given by the microprocessor to the processing units are converted.

The invention claimed is:

1. A method for controlling a screening machine comprising a vibrating screen having at least one screen surface, said vibrating screen conveying material from a first end towards a second end, feeding means comprising a conveyor that feeds material to be screened towards the screen surface and at a fixed location in the first end onto the screen surface where the material is separated into a first fraction remaining on the screen surface and into a second fraction passed through the screen surface while the material is moving along the screen surface towards the second end, the method comprising:

determining the amount of material on the screen surface by automatic measurement; and controlling the amount of material on the screen surface by adjusting the conveying speed of the conveyor on the basis of the measurement by automatic control in such a manner that the conveying speed, which is above zero, is changed to a different conveying speed, which is above zero, in both of the following ways:

a) providing upper and lower preset values ($val_{max}$, $val_{min}$) for the measurement value ($val_m$) of a variable dependent on the amount of material on the screen surface, lowering the conveying speed of the conveyor without stopping the conveyor when the measurement value ($val_m$) passes one of the preset values, and increasing the conveying speed of the conveyor when the measurement value ($val_m$) passes the other preset value, and b) providing a preset value ($(\Delta val_m/\Delta t)_{max}$) for a speed of change of the measurement value ($val_m$) of the variable dependent on the amount of material on the screen surface, and changing the conveying speed of the conveyor without stopping the conveyor when the speed of change of the measurement value ($val_m$) of the variable exceeds the preset value ($(\Delta val_m/\Delta t)_{max}$).

2. The method according to claim 1, wherein determining the amount of material on the screen surface comprises measuring a variable of the movement of the screen surface or a variable of the drive means of the screen surface causing the movement of the screen surface.

3. The method according to claim 2, wherein measuring the load caused by the material on the screen comprises measuring a variable of the screen drive means causing the transport or processing of the material on the screen surface.

4. The method according to claim 3, wherein the variable is a drive pressure, drive current or drive running speed.

5. The method according to claim 1, wherein determining the amount of material on the screen surface comprises measuring the load caused by the material on any processing unit of the screening machine or on any machine following the screening machine and extending the process of the screening machine and being connected to the control system of the screening machine.

6. The method according to claim 5, wherein the processing unit is any of the following: a discharge conveyor, a shredder, or a crusher.

7. The method according to claim 6, wherein measuring the load comprises measuring any of the following variables:

drive pressure of the discharge conveyor, shredder or crusher, drive current of the discharge conveyor, shredder or crusher, or running speed of the discharge conveyor, shredder or crusher.

8. The method according to claim 5, wherein the machine following the screening machine and extending the process of the screening machine and being connected to the screening machine's control system is any of the following:

a second screening machine, a crushing machine, or a conveying machine.

9. The method according to claim 5, wherein measuring the load comprises measuring the load on an engine caused by the material.

10. The method according to claim 5, wherein measuring the load comprises measuring the temperature of a hydraulic fluid of a hydraulic system.

11. The method according to claim 1, further comprising presetting a maximum speed and a minimum speed for the conveyor.

12. The method according to claim 1, further comprising:

providing a predetermined maximum time ($t_{max}$) for the measurement value ($val_m$) to be beyond the preset value; and lowering the speed of the conveyor below a preset speed value when the measurement value ($val_m$) has been beyond the preset value for a period that exceeds the predetermined maximum time ($t_{max}$).

13. The method according to claim 12, further comprising stopping the conveyor when the measurement value ($val_m$) has been beyond the preset value for the period.

14. A screening machine comprising a vibrating screen having at least one screen surface and adapted to convey material from a first end to a second end, feeding means comprising a conveyor arranged to feed material to be screened towards the screen surface and at a fixed location in the first end onto the screen surface, the screen surface being capable of separating the material into a first fraction remaining on the screen surface and into a second fraction passed trough the screen surface while the material is moving along the screen surface towards the second end, the screening machine further comprising:

a sensor arranged to measure a variable dependent on the amount of material on the screen surface;

a controller to which said sensor is connected through a data transmission line to receive a measurement value ($val_m$) related to said variable from the sensor; and an actuator operatively connected to the conveyor and arranged to change the conveying speed of the conveyor, wherein said controller is connected to said actuator through a data transmission line and arranged to give a control command to said actuator in response to the measurement value ($val_m$) received from the sensor to change the conveying speed of the conveyor, which is above zero, to a different conveying speed, which is above zero, in both of the following ways:

a) an upper preset value ($val_{max}$) and a lower preset value ($val_{min}$) for the measurement value ($val_m$) are programmable and changeable in the controller and the controller is arranged to give a conveying speed reducing control command, which does not stop the conveyor, to the conveyor when the measurement value ($val_m$) passes one of the preset values ($val_{max}$, $val_{min}$), and a conveying speed increasing control command when the measurement value passes the other preset value, and b) a preset value ($(\Delta val_m/\Delta t)_{max}$) for the speed of change of the measurement value ($val_m$) is programmable and changeable in the controller and the controller is arranged to give a conveying speed changing control command, which does not stop the conveyor, to the conveyor when the speed of change exceeds the preset value ($(\Delta val_m/\Delta t)_{max}$).

* * * * *